United States Patent [19]

Radcliffe et al.

[11] 4,252,498

[45] Feb. 24, 1981

[54] CONTROL SYSTEMS FOR MULTI-STAGE AXIAL FLOW COMPRESSORS

[75] Inventors: Alan G. Radcliffe, Littleover; Peter G. G. Farrar, Mickleover, both of England

[73] Assignee: Rolls-Royce Limited, London, England

[21] Appl. No.: 15,762

[22] Filed: Feb. 28, 1979

[30] Foreign Application Priority Data

Mar. 14, 1978 [GB] United Kingdom ..... 10027/78

[51] Int. Cl.[3] ..... F01D 7/00; F01D 17/00; F04D 27/00

[52] U.S. Cl. ..... 415/26; 60/39.28 R

[58] Field of Search ..... 415/26, 23, 29, 13, 415/118, 148, 159, 162, DIG. 6; 60/39.28 R

[56] References Cited

U.S. PATENT DOCUMENTS

| | | | |
|---|---|---|---|
| 1,401,668 | 12/1921 | Brown et al. | 415/26 |
| 2,689,680 | 9/1954 | Lovesey | 415/26 |
| 2,705,590 | 4/1955 | Lovesey et al. | 415/26 X |
| 2,993,640 | 7/1961 | Moreillon | 415/26 |
| 3,362,626 | 1/1968 | Schlire | 415/26 X |
| 3,403,842 | 10/1968 | Roche . | |
| 3,737,246 | 6/1973 | Shirato | 415/26 X |
| 3,783,903 | 1/1974 | Cantwell | 60/39.28 R X |
| 3,868,625 | 2/1975 | Speigner et al. | 60/39.28 R X |

FOREIGN PATENT DOCUMENTS 1223490 2/1971 United Kingdom .

*Primary Examiner*—Stanley N. Gilreath
*Attorney, Agent, or Firm*—Cushman, Darby & Cushman

[57] ABSTRACT

A control system is provided for the multi-stage axial flow compressor of a gas turbine engine. The control system embraces a stage of variable angle guide vanes, a first detector adapted to detect a first pressure in the compressor which is influenced by the vane angular setting, and a second detector adapted to detect a second pressure independent of the vane setting but bearing a functional relationship to the rotational speed of a compressor of the engine. A control unit is adapted to use the pressures detected by the detectors to cause an actuation mechanism to adjust the angular setting of the guide vanes in a predetermined manner dependent upon the ratio of the second pressure to the first pressure.

12 Claims, 6 Drawing Figures

CONTROL SYSTEMS FOR MULTI-STAGE AXIAL FLOW COMPRESSORS

Figure 1:
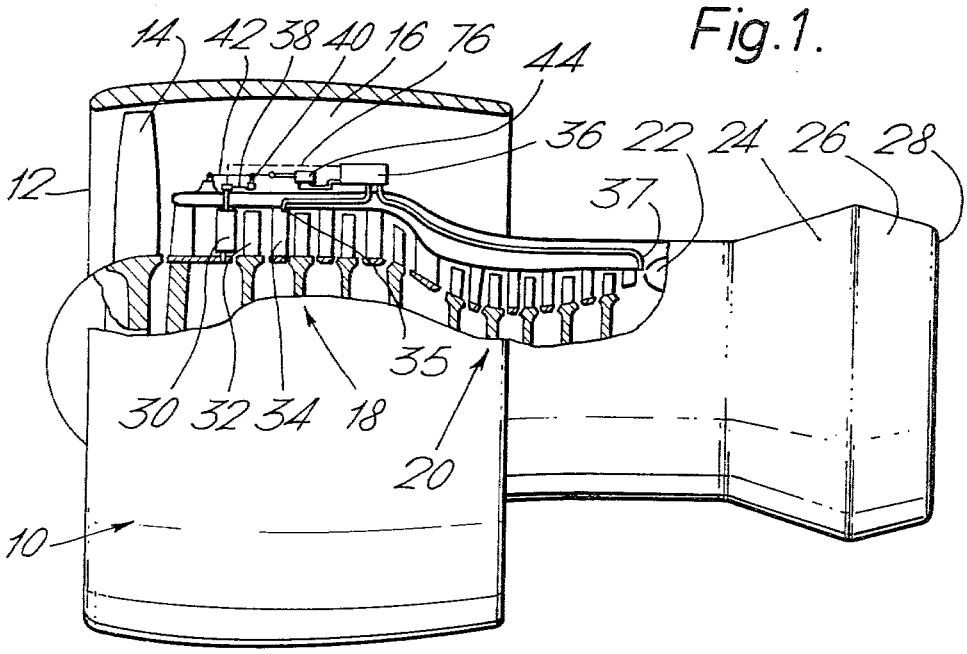

This invention relates to control system for multi-stage axial flow compressors of gas turbine engines.

A basic problem with an axial flow compressor is stall or surge, which can occur when the pressure, velocity and rotational speed relationship of the compressor is disturbed so that it is operating outside its design characteristics. Stall or surge is a breakdown of the smooth pattern of flow through the compressor into violent turbulence, a stall referring to a breakdown in flow in only some of the stages of a multi-stage compressor and a surge generally referring to a complete breakdown of smooth air flow through the compressor.

The value of airflow and pressure ratio of the compressor at which a surge occurs is termed the 'surge point'. This point is a characteristic of each compressor speed, and a line which joins all the surge points, drawn on a graph of pressure ratio against mass flow, and called the 'surge line', defines the minimum stable airflow which can be obtained at any rotational speed. A compressor is normally designed to have a good safety margin between the values of airflow and compression ratio at which it will normally be operated, and the values of airflow and compression ratio at which a surge will occur.

It is usually necessary to use a system of airflow control to ensure the efficient operation of an axial flow compressor over a wide speed range and to maintain the abovementioned safety margin. The system usually involves bleeding compressor air from an intermediate stage and/or providing a row of variable angle guide vanes arranged so that their angle is adjusted to minimise stalling of the rotor blades immediately downstream of the variable guide vanes at "off design" engine conditions. Such variable guide vanes are normally provided at the compressor intake but they may be provided in front of a number of rotor blade stages or even all of the rotor blade stages.

The variable guide vanes give a predetermined degree of whirl to the air passing to the rotor blades immediately downstream thereof and ensure that the air is delivered to the rotor blades at substantially the correct velocity and angle depending on the various conditions existing in the compressor. Thus the overall effect of the variable guide vanes is to adjust the position of the surge line.

Various methods are used for automatically adjusting the angles of the variable guide vanes, and clearly their rate of response and the angles they adopt are very important. It is an object of the present invention therefore to provide an efficient control system for such variable guide vanes which will reduce the likelihood of stalls and surges when the compressor is operating at "off-design" conditions.

According to the present invention a control system for a multi-stage axial flow compressor of a gas turbine comprises a stage of variable angle guide vanes, a first detector adapted to detect a first pressure in the compressed fluid flow downstream of the variable angle guide vanes which is influenced by the setting of the vanes, a second detector adapted to detect a second, higher pressure in the compressed fluid which is substantially independent of the setting of the vanes but is functionally dependent upon the rotational speed of a compressor of the engine, and a control unit adapted to use the pressures detected by the detectors to cause an actuation mechanism to adjust the setting of the angle of the variable angle guide vanes in a predetermined manner dependent upon the ratio of the second and first pressures.

The first pressure may be a pressure existing in one of the four stages of rotor and stators immediately following the stage of variable angle guide vanes, and is preferably the pressure existing adjacent to the subsequent set of guide vanes.

Preferably the variable guide vanes are located adjacent to the inlet of the compressor, although more than one set of variable guide vanes may be provided each having its own control system.

The second higher pressure may be the compressor delivery pressure or it may be the delivery pressure of a further compressor arranged in flow series with the compressor downstream thereof.

The means for adjusting the angle of the guide vanes is preferably a fluidic amplifier, the first and second pressure being used directly to cause operation of the amplifier.

Preferably an increase in the ratio between the second higher pressure and the first pressure is such as to reduce the angle between the guide vanes and the axis of the engine.

The invention also comprises a gas turbine engine having a control system for a multi-stage axial flow compressor as set forth above.

Figure 2:
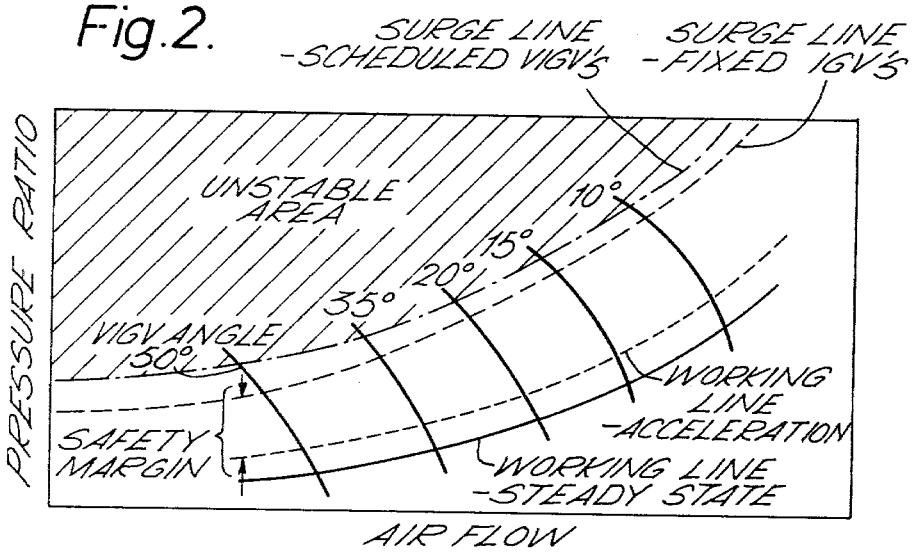
Figure 3:
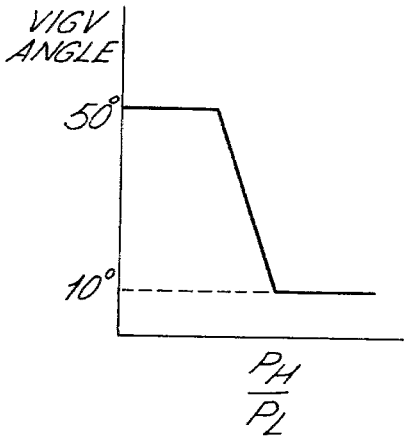
Figure 4:
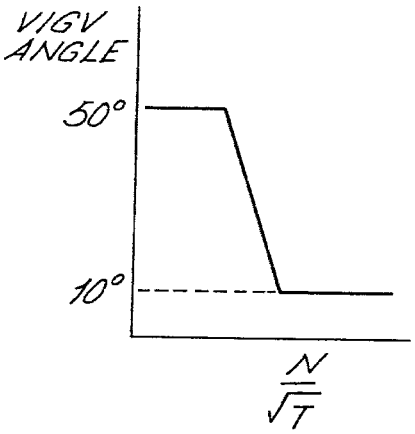
Figure 5:
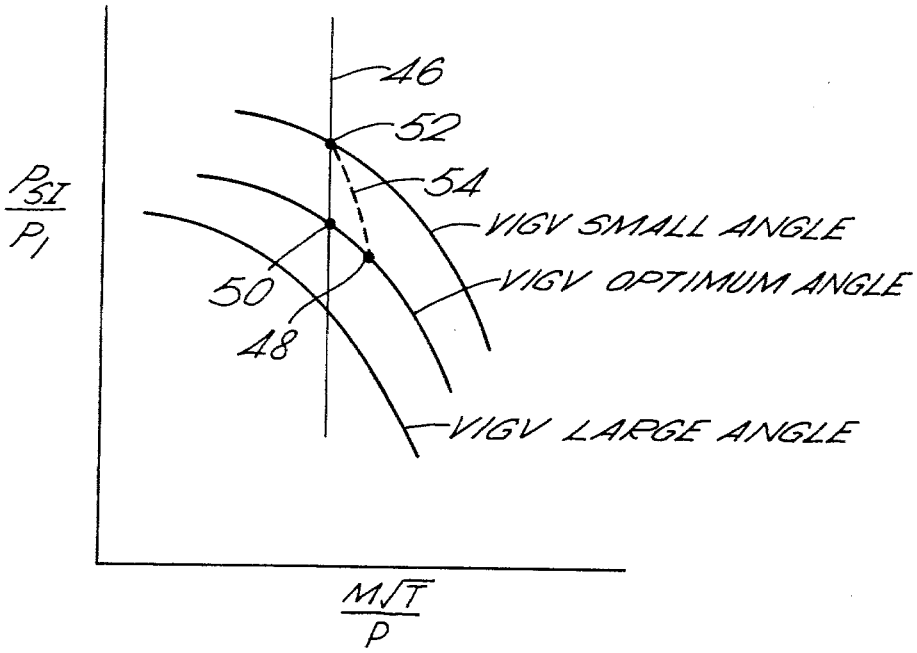
Figure 6:
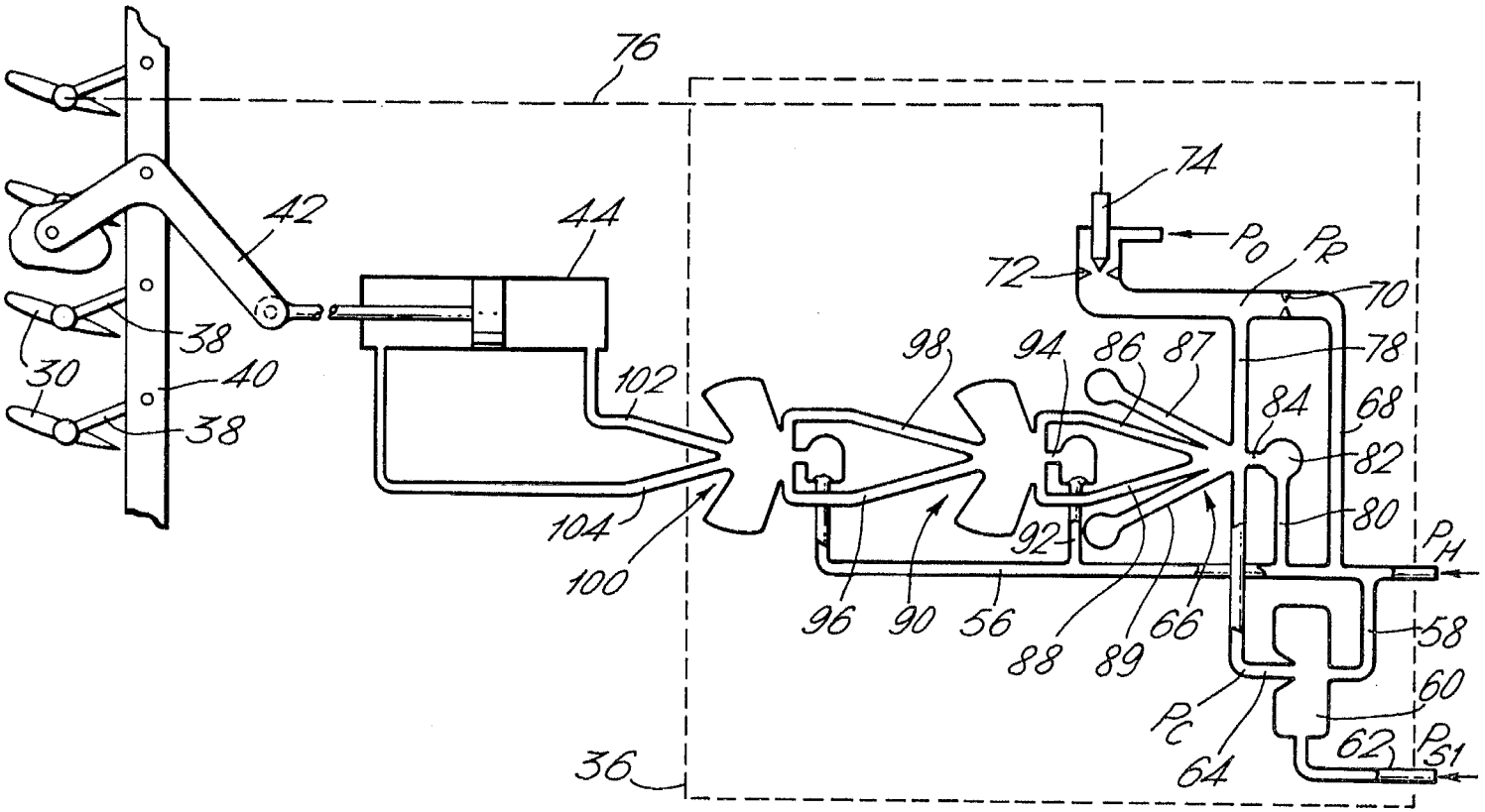

An embodiment of the invention will now be described by way of example only in which:

FIG. 1 is a cutaway cross-sectional view of a gas turbine engine having a control system in accordance with the invention, FIG. 2 is a graph of compressor pressure ratio against airflow, FIGS. 3 and 4 are graphs of guide vane angle against a pressure ratio and an engine speed related value respectively, FIG. 5 is a graph showing the relationship between the pressure rise across a variable inlet guide vane and the following rotor blade row and compressor mass flow, and FIG. 6 is a diagrammatic view of the control system of FIG. 1.

In FIG. 1 there is shown a gas turbine engine 10 of the turbofan type comprising an air intake 12, a fan 14 adapted to supply air to a fan duct 16 and to multi-stage axial-flow intermediate and high pressure compressors 18 and 20, combustion equipment 22, turbine means 24, a jet pipe 26 and an exhaust nozzle 28. The fan 14 and the compressors 18 and 20 are driven by the turbine means which in turn are powered by the hot gases from the combustion equipment 22.

There can be two or three separate turbines arranged in flow series, in the former case a low pressure turbine drives the fan 14 and the intermediate pressure compressor 18, and in the latter case, an intermediate pressure turbine drives the intermediate pressure compressor 18. In each case the high pressure compressor 20 is driven by a high pressure turbine.

The intermediate pressure compressor 18 is provided with a set of variable inlet guide vanes 30 which are located immediately upstream of the first stage of rotor blades 32 of the compressor. A set of fixed stator vanes 34 is located immediately downstream of the set of rotor blades 32. In order to adjust the angles of the variable inlet guide vanes 30, each vane is connected via a lever 38 to a common unison ring 40. The ring may be moved circumferentially by a bell-crank lever 42 which is actuated by a pneumatic ram 44. This ram is operated by the control unit 36 described below.

The variable inlet guide vanes (VIGV) are adjusted automatically by the control system according to the invention, and ideally should be adjusted to follow a predetermined schedule as the engine speed varies, as shown in FIG. 4. The VIGV angle is preferably varied between set limits, typically from about 50° to 10° to the axis of the engine as the engine speed varies. (In FIG. 4 the engine speed N is adjusted by the term $\sqrt{T}$ to take account of varying ambient temperature, which has a pronounced affect on the performance of the engine). The term $N/\sqrt{T}$ can be replaced by a pressure ratio $P_H/P_L$ which is shown on FIG. 3, $P_H$ being the delivery pressure of the high pressure compressor 20, and $P_L$ being a lower pressure taken from another part of the engine airflow; one example of this has been the fan flow pressure which exists in the duct 16.

These two pressures are detected by suitable means and are supplied to a VIGV control unit 36. This control unit is arranged to adjust the angle of the VIGV's (by actuating the ram 44 connected to the VIGV's) in accordance with the pressure ratio $P_H/P_L$ to follow the schedule line shown in FIG. 3.

Certain circumstances can cause the pressure $P_H$ to change rapidly with an insufficient corresponding change in $P_L$ causing the VIGV's to be adjusted off the schedule line shown on FIG. 3. Such a situation occurs when the engine is suddenly required to be accelerated (known as slam acceleration) and the engine throttle is opened wide to admit more fuel to the combustion equipment. In this case $P_H$ increases rapidly, increasing the ratio $P_H/P_L$ and reducing the VIGV angle before the engine speed has increased. This has a twofold effect which is illustrated on FIG. 2. The working line of the compressor 18 rises when the fuel supply is increased to accelerate the engine, and since the VIGV's are set to a smaller angle than that schedule for the engine speed, the surge line is lowered. The safety margin, which is proportional to the gap between the working line and the surge line is consequently reduced.

It is to avoid this kind of effect that the control system of the present invention has been derived. In the present invention the lower pressure $P_L$ is arranged to be a pressure in the duct downstream of the variable IGV's 30 and to be taken from a point sufficiently close to the IGV's so that the pressure depends on the angle of the variable vanes. This is true of the pressures for the first four stages of rotors and stators downstream of the variable vanes, but it is clearly most pronounced in positions closely downstream of the vanes. In the present embodiment we choose to use the pressure $P_{S1}$; that is the pressure existing at the stator vanes 34 in the intermediate pressure 18, immediately downstream of the first set of rotor blades 32. This pressure is detected by the tapping 35, while the higher pressure is detected by the tapping 37.

Therefore, since the pressure $P_{S1}$ is detected immediately downstream of the set of rotor blades 32 in accordance with the invention, the reducing angle of the VIGV's occurring in a slam acceleration is rapidly detected and used to restore the VIGV's to a greater angle. Thus the surge line rises to approximately its correct level and the safety margin is increased accordingly.

This is illustrated in FIG. 5 which is a graph of the pressure rise across the VIGV's and the following rotor blade row ($P_{S1}/P_1$) against a function of mass flow through the compressor. $P_1$ is the pressure at the inlet to the compressor 18, before the IGV's 30. As the mass flow increases the ratio $P_{S1}/P_1$ decreases along three curves which are characteristics for VIGV small angle, optimum angle and large angle to the axis of the engine. If $P_H$ increases gradually, causing the VIGV's to adopt a smaller angle, the mass flow initially reduces, and assuming the engine to be on schedule with optimum VIGV angle at a point 48 the ratio $P_{S1}/P_1$ would increase until a new point 50 is reached. However, with a sudden increase in $P_H$, there is a sudden reduction in VIGV angle as well as a reduction in mass flow. The engine will thus move off schedule to a point 52 from the point 48 along the broken line 54. $P_{S1}$ is thus increased over its schedule value at position 50, and this increase is fed to the VIGV control unit 36 to cause the VIGV angle to be increased and reduce the ratio $P_{S1}/P_1$. At a constant mass flow the working point moves back down the lines 46 to the point 50 so that the compressor is again working on schedule.

Similar effects can also occur during slam decelerations, when the VIGV's can suddenly move to an increased angle, although in this case although the surge line lowers, the working line also lowers and the safety margin is not substantially affected. In a Bodie surge when a slam deceleration is followed immediately by a slam acceleration with no stabilisation period between deceleration and acceleration and little or no change in engine speed the VIGV's move rapidly from their scheduled setting to a large angle and then to a small angle. The possibility of a surge is high during such a monoeuvre because of the significantly lowered surge line but because of the use of the pressure $P_{S1}$, the VIGV's are rapidly readjusted to keep them on schedule.

Thus the control system provides a VIGV control which has an almost immediate negative feedback and results in a stable system with a corresponding reduction in the possibility of a surge.

The pressure $P_H$ although described as the delivery pressure of the high pressure compressor could be taken from various positions in the intermediate compressor or the high pressure compressor, but must be higher than $P_{S1}$, must increase with compressor speed at a steady working state of the engine, and must be affected by the position of the IGV's to a lesser degree than is the lower control pressure. It must also be responsive to combustion chamber pressures and thus the high pressure delivery pressure is considered to be the optimum pressure to use.

It will be evident to those skilled in the art that a variety of different mechanical, electrical, hydraulic or pneumatic systems could be used to carry out the function required of the control unit 36. However, as an example a pneumatic system is illustrated diagrammatically in FIG. 6 and is described below. It shall be noted that in basic concept this system is similar to that described in U.S. Pat. No. 3,783,903, issued Jan. 8, 1974, to Hugh Francis Cantwell, and commonly assigned to Rolls-Royce Limited.

In the control unit 36 of FIG. 6 pneumatic or fluidic devices are used so that the pneumatic output is suitable for direct use in a pneumatic ram 44. One of the two pressures $P_H$ used for controlling is fed to a manifold conduit 56, and various tappings from this conduit allow the air pressure to be used both as a control pressure and as a driving pressure in various of the fluidic amplifiers used. The first tapping through the conduit 58 feeds $P_H$ to the input orifice of a jet collector device 60. The dump connection 62 of this device is connected to the tapping for the other control pressure, $P_{S1}$. The output from the jet collector 60 appears at the output passage 64 as a control pressure denoted as $P_C$ in the drawing.

The jet collector device 60, as is well known in the art, has an output related to its inputs in such a way that the ratio $P_C/P_{S1}$ increases almost linearly but quite slowly with the ratio $P_H/P_{S1}$ until a saturation value is reached, when the value $P_C/P_{S1}$ ceases to increase to any large extent with increasing $P_H/P_{S1}$. Its output $P_C$ is fed along the line 64 to form a control input of a first fluidic amplifier 66.

The second tapping 68 from the manifold 56 takes $P_H$ to a first, fixed orifice 70. The tapping 68 continues past the orifice 70 to a second variable orifice 72, and in the length of tapping between these orifices a reference pressure $P_R$ is produced. The variable orifice 72 is shown as being variable by an obturating member 74 which is operated via a connecting link 76 from the variable vanes 30, thus the area of this orifice varies in accordance with the angular position of the vanes. The side of the orifice 72 remote from the fixed orifice 70 is vented. to vent pressure referred to as $P_O$, therefore the pressure $P_R$ lies between $P_H$ and $P_O$ with its value in this pressure range being determined by the size of orifice 72 and hence the angular position of the vane 30. It varies, for a fixed setting of the orifice 72, more rapidly with $P_H$ than does $P_C$.

It will be noted that the variable orifice 72 is shown diagrammatically as being varied by the degree of penetration of a shaped needle device. In practice this orifice may well comprise a slot whose open area is varied by a cam plate which lies over and partly obstructs the slot, rotation of the cam plate varying the degree of obstruction of the orifice. Clearly it is quite simple to arrange that the angular position of the cam is linked with that of the variable vanes 30.

For all constructions of the variable orifice 72, the reference pressure $P_R$ is fed through a duct 78 to form the second control input for the amplifier 66. In this amplifier the control inputs of $P_C$ and $P_R$ in the ducts 64 and 78 act in opposed directions on a jet of the driving pressure. This pressure comprises $P_H$ which is tapped from the manifold 56 via a tapping 80. It then feeds a chamber 82 and passes through a nozzle 84 in the form of a jet.

Depending upon which of the pressures $P_C$ and $P_R$ is the higher, so the jet from the nozzle 84 is deflected into one of the output passages 86 and 88. Vent passages 87 and 89 are connected to a vent pressure (not shown). As is well known in the fluidics art, the device therefore provides an output from the passages 86 and 88 which is an amplified version of the input to the passages 64 and 78.

These outputs from the amplifier 66 are used as the inputs to a second amplifier 90 which again uses as drive pressure $P_H$ taken via tapping 92 from the manifold 56. Operation of this amplifier is similar to that of 66 in that the inputs in 86 and 88 deflect a jet of $P_H$ from the nozzle 94 into one of the outputs 96 or 98. Once more the remaining area of the amplifier is connected to the vent pressure.

A further stage of amplification of these outputs is then provided by an amplifier 100 which is exactly similar in operation to the amplifier 90 and is therefore not described in detail. It will be clear that the output in the ducts 102 and 104 from the amplifier 100 will comprise an amplified version of those in the outputs 96 and 98.

The effect of the three series amplifiers 66, 90 and 100 is to provide at the output passages 102 and 104 a much magnified version of control and reference pressures $P_C$ and $P_R$ in the ducts 64 and 78. The amplification provided is arranged to be sufficient to enable the pressures in 102 and 104 to operate the pneumatic ram 44 directly.

To understand the operation of the system, consider that the system is initially stable with the pressures $P_C$ and $P_R$, and hence the output pressures in 102 and 104 equal. The ram 44 is thus static as are the vanes 30. If the engine is now accelerated by increasing the fuel flow to the combustion chamber, $P_H$ will increase quickly while $P_{S1}$ does not change as rapidly. $P_R$ therefore changes by a greater amount than $P_C$, and the amplifier output from 66 becomes large in 88 and small in 86. After passing through amplifiers 90 and 100 the result is that a higher pressure is developed in 104 and low in 102, the ram 44 therefore retracts, operating the lever 42, the ring 40, the levers 38 and thus the vanes 30, turning the vanes anti-clockwise as viewed in FIG. 6 and reducing the vane angle.

This rotation of the vanes opens the orifice 72 via the link 76 via the link 76, and at the same time $P_{S1}$ increases due to the reduced angle of the vanes. Therefore $P_R$ reduces and $P_C$ increases, quickly restoring the balance of the pressures in 102 and 104 maintaining the vanes 30 in their correct position.

Deceleration of the engine by reducing the fuel flow to the combustion chamber will of course have exactly the reverse effect, but again the close relationship of $P_{S1}$ to the vane angle will enable a quick and accurate response by the control system.

Whilst only one set of VIGV's is disclosed in this description, all or several of the stator sets may be variable. Thus all the sets of VIGV's may be controlled together according to one pressure ratio as hereinbefore described or they each may be controlled independently using a separate pressure ratio control for each set. Alternatively several sets of VIGV's may be controlled by one pressure ratio and several further sets by another pressure ratio. If more than one set is variable, it is clearly possible to choose a pressure anywhere downstream of the first row of variable vanes which may be inbetween this mass or may be a small amount downstream of the last variable vane.

We claim:

1. A control system for a multi-stage axial flow compressor means which compresses a working fluid of a gas turbine engine, said control system comprising:

a stage of variable angle guide vanes in said compressor means;

a first detector positioned to detect a first pressure in the compressed working fluid downstream of said variable angle guide vanes at a location where said first pressure is influenced by a setting of said variable angle guide vanes;

a second detector positioned to detect a second higher pressure than said first pressure in the compressed fluid at a location downstream of said first pressure where said second higher pressure is substantially independent of the setting of said variable angle guide vanes and functionally dependent upon rotational speed of a compressor means of the engine;

an actuation mechanism operatively connected to said variable angle guide vanes for adjusting the angular setting of the same; and a control unit means operatively connected to said actuation mechanism for actuating the same, said control unit means being operatively connected to said first detector and said second detector and controlled in a predetermined manner dependent on a ratio of said second higher pressure and said first pressure for causing said actuation mechanism to adjust the setting of the angle of said variable angle guide vanes.

2. A control system as claimed in claim 1 in which said compressor means comprises at least one compressor with at least four alternate stages of rotor and stator blades located immediately downstream of said variable angle guide vanes, and in which said first pressure being detected by said first detector is pressure existing in one of said four stages of rotor and stator blades.

3. A control system as claimed in claim 2 in which a first stage of said at least four stages is a stage of rotor blades and in which a second stage immediately downstream of said first stage is a row of stator vanes and in which said first pressure being detected by said first detector is the pressure in said last mentioned row of stator vanes.

4. A control system as claimed in claim 1 in which said second detector detects said second higher pressure at a delivery end of said compressor means.

5. A control system as claimed in claim 1 in which said compressor means includes a plurality of axial flow compressors in flow series.

6. A control system as claimed in claim 5 in which said plurality of compressors includes a low pressure compressor and a high pressure compressor connected in flow series, said low pressure compressor having said variable angle guide vanes and said high pressure compressor having a delivery end where said second detector detects said second higher pressure.

7. A control system as claimed in claim 1 in which said first detector and said second detector each comprises pressure tappings.

8. A control system as claimed in claim 7 in which said control unit means comprises a fluidic device operable on said ratio of the second higher pressure and the first pressure delivered from said pressure tappings.

9. A control system as claimed in claim 8 in which said actuation mechanism includes a pneumatic ram and in which said fluidic device includes means to produce a pneumatic output, said means being connected to said ram for operating the same to adjust the angle of said variable angle guide vanes dependent on said ratio.

10. A control system as claimed in claim 8 and in which said fluidic device includes a duct in which a fixed orifice and a variable orifice are mounted in flow series, said duct receiving said second pressure at its end adjacent the fixed orifice and being vented to a vent pressure at its end adjacent the variable orifice, connection means operatively interconnecting the variable orifice and one of the variable guide vanes so that the area of the variable orifice varies in a predetermined manner with the angular setting of the guide vanes, the pressure in the duct between the orifices forming a reference pressure for the unit.

11. A control system as claimed in claim 10 and in which said fluidic device includes a jet collector device having a drive input, a dump connection and an output, said drive input receiving said second pressure, said dump connection receiving said first pressure, and said output providing a control pressure for the unit.

12. A control system as claimed in claim 11 and in which the fluidic device includes fluidic amplifiers for amplifying said reference and control pressures to provide outputs suitable for operating said pneumatic ram.

* * * * *